US005986532A

United States Patent [19]

Kikuta et al.

[11] Patent Number: 5,986,532

[45] Date of Patent: Nov. 16, 1999

[54] IGNITION COIL FOR AN INTERNAL COMBUSTION ENGINE

[75] Inventors: Hikaru Kikuta, Takahama; Katsuo Yoshihara, Kariya, both of Japan

[73] Assignees: Aisan Kogyo Kabushiki Kaisha, Obu; Miyama-Seiko Manufacturing Co., Ltd., Chiryu, both of Japan

[21] Appl. No.: 08/863,187

[22] Filed: May 27, 1997

[30] Foreign Application Priority Data

May 29, 1996 [JP] Japan ..... 8-158813

[51] Int. Cl.[6] ..... H01F 15/02; H01F 27/24

[52] U.S. Cl. ..... 336/83; 336/96; 336/110; 336/212; 336/234

[58] Field of Search ..... 336/234, 212, 336/110, 213, 83, 96

[56] References Cited

U.S. PATENT DOCUMENTS

| | | | |
|---|---|---|---|
| 2,671,951 | 3/1954 | Sliwiak | 336/234 |
| 3,137,832 | 6/1964 | Hurt, Jr. et al. | 336/234 |
| 3,497,949 | 3/1970 | Salt | 336/234 |
| 4,897,916 | 2/1990 | Blackburn | 336/234 |
| 4,963,849 | 10/1990 | Kowalczyk et al. | 336/234 |
| 5,210,930 | 5/1993 | Watabe et al. | 336/213 |
| 5,268,663 | 12/1993 | Takeuti et al. | 336/212 |
| 5,703,556 | 12/1997 | Kikuta et al. | 336/110 |

FOREIGN PATENT DOCUMENTS 4-87311 3/1992 Japan .

*Primary Examiner*—Thomas J. Kozma
*Attorney, Agent, or Firm*—Oliff & Berridge, PLC

[57] ABSTRACT

The invention is directed to an ignition coil for an internal combustion engine which includes a columnar member having a plurality of magnetic plates, e.g., silicon steel plates stacked one on the other with stacked portions formed on the magnetic plates. The magnetic columnar member includes a first portion having a plurality of magnetic plates stacked one on the other in accordance with increase of a width of each plate, a second portion connected to the first portion and having a plurality of magnetic plates with the same width stacked stacked one on the other, and a third portion connected to the second portion and having a plurality of magnetic plates stacked one on the other in accordance with decrease of a width of each plate, thereby to form the columnar member with a middle portion thereof having a substantially circular cross section. The ignition coil further includes a primary winding and a secondary winding which are wound around the columnar member, a magnetic cylindrical member in which the columnar member is received. A plurality of rectangular recesses are formed on one side of each magnetic plate, and a plurality of rectangular protrusions are formed on the other side of each magnetic plate, to form a plurality of rectangular stacked portions on the columnar member.

12 Claims, 7 Drawing Sheets

IGNITION COIL FOR AN INTERNAL COMBUSTION ENGINE

BACKGROUND OF THE INVENTION

1. Field of the Invention

The present invention relates to an ignition coil for use in an internal combustion engine, more particularly to an ignition coil having a columnar member with a plurality of magnetic plates stacked one on the other, and a primary winding and a secondary winding wound around the columnar member.

2. Description of the Related Arts

Recently, an ignition coil having a columnar configuration has been proposed so as to place the ignition coil within a cylindrical plug hole formed in an internal combustion engine. In Japanese Patent Laid-open Publication No. 4-87311, for example, there is disclosed an ignition coil having a central core assembled by a plurality of wires made of magnetic material to form a columnar configuration. In that publication disclosed are various methods for producing the central core assembled by the wires, such as a method for drawing the wires through a cylindrical die, a method for placing the wires between an upper die and a lower die, and then pressing them to form the core, a method for aligning the wires and pressing them in dies together with metallic powder, with resin powder adhered thereto, a method for placing the wires within a silicon steel pipe and then drawing the pipe through a die while heating them, and a method for rolling a silicon steel plate double or triple and then drawing it through a die. In that publication, also disclosed is a central core which is assembled by a plurality of wires to form opposite end portions having a rectangular cross section and a middle portion having a circular cross section.

As disclosed in the Publication No. 4-87311, when the ignition coil is to be formed in a cylindrical shape, it is desirable to form the central core or inner core also in the cylindrical shape. However, the methods for assembling a plurality of wires as described above can not be easily made, so that any of the methods will result in increase in cost.

Supposing that a conventional process for stacking a plurality of steel plates is employed to form a columnar core, the core will be formed as shown in FIGS. 13–16. That is, a plurality of silicon steel plates MPx having different width from one another are formed as shown in FIGS. 13–16. A recess is formed on one side of each steel plate MPx, and a protrusion is formed on the other side of each steel plate MPx. The silicon steel plates MPx are stacked one on the other under pressure to form an inner core 10*x* having stacked portions Stb. This "stacking process" is a process for forming a recess on one side, e.g., under side of each of a plurality of flat plates and a protrusion on the other side, e.g., upper side of each of the plates, when the plates are stamped, and then stacking the plates one on the other with each protrusion press-fitted into each recess mating with the protrusion to form a plurality of stacked portions on the plates.

According to the above process, however, if a columnar inner core having a diameter of e.g., 8 mm, is formed by the above process, the width of the outermost plate will be as small as 2 mm, as can be seen in FIG. 13. Therefore, if a plurality of steel plates are connected one another by the stacking process, the diameter of the stacked portion will be small in diameter to have a connecting strength of smaller than 2 kgf, so that the stacked plates will be easily peeled off. In the case where the columnar inner core is produced, the wider steel plate is stacked on the narrower steel plate in sequence to broaden the width of the stacked plates gradually, and then the narrower steel plate is stacked on the wider steel plate in sequence to narrow the width of the stacked plates gradually. In this case, however, if the wider steel plate is stacked on the narrower steel plate, the staked plates will be likely bent along the longitudinal direction, so that the stacking process will be difficult. As a result, a stamping process using a progressive die can not be employed, so that the productivity will be reduced and the manufacturing cost will be raised.

SUMMARY OF THE INVENTION

Accordingly, it is an object of the present invention to provide an ignition coil having a magnetic columnar member and primary and secondary windings wound on the columnar member for use in an internal combustion engine, wherein the columnar member having a substantially circular cross section can be easily formed by stacking a plurality of magnetic plates with a sufficient connecting strength.

In accomplishing the above and other objects, an ignition coil for an internal combustion engine includes a magnetic columnar member having a plurality of magnetic plates stacked one on the other with stacked portions formed on the magnetic plates. The magnetic columnar member includes a first portion having a plurality of magnetic plates stacked one on the other in accordance with increase of a width of at least a middle portion of each plate, a second portion connected to the first portion and having a plurality of magnetic plates with at least a middle portion thereof having the same width stacked one on the other, and a third portion connected to the second portion and having a plurality of magnetic plates stacked one on the other in accordance with decrease of a width of at least a middle portion of each plate, thereby to form the columnar member with a middle portion thereof having a substantially circular cross section. A primary winding and a secondary winding are wound around the columnar member, and a magnetic cylindrical member is provided for receiving therein the columnar member with the primary winding and the secondary winding wound around the columnar member. Preferably, the magnetic plates are made of silicon steel plates. Accordingly, the ignition coil including a plurality of magnetic planar plates stacked one on the other with strength enough to connect therebetween.

According to the ignition coil as described above, it is preferable that a plurality of rectangular recesses are formed on one side of each of the magnetic plates, and a plurality of rectangular protrusions are formed on the other side of each of the magnetic plates. The recesses and the protrusions are connected to form a plurality of rectangular stacked portions on the columnar member, such that a longer side of at least one of the rectangular stacked portions is perpendicular to a longer side of another one of the rectangular stacked portions. It may be so arranged that the longer side of each rectangular stacked portion formed at the opposite ends of the columnar member is perpendicular to the longer side of each rectangular stacked portion formed between the opposite ends of the columnar member.

In the ignition coil as described above, a plurality of through holes may be formed on the narrowest plate in the first portion to be connected to the protrusions of the magnetic plates mating with the narrowest plate.

BRIEF DESCRIPTION OF THE DRAWINGS

The above stated objects and following description will become readily apparent with reference to the accompanying drawings, wherein like reference numerals denote like elements, and in which.

DESCRIPTION OF THE PREFERRED EMBODIMENT

Figure 1:
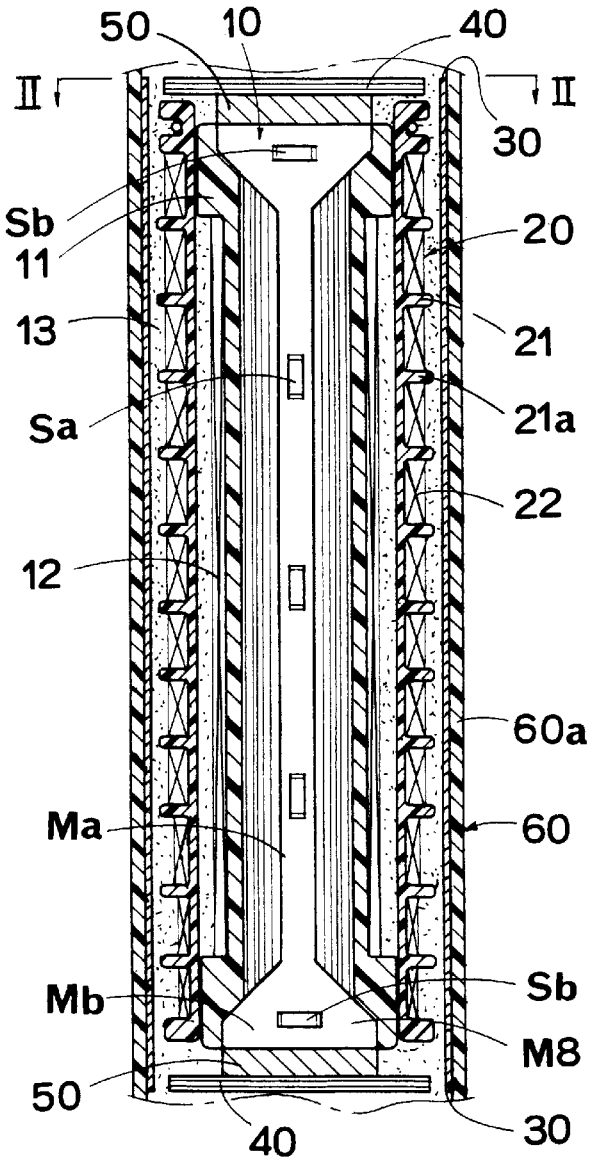
FIG. 1 is a sectional view of an ignition coil for an internal combustion engine according to an embodiment of the present invention.
Figure 2:
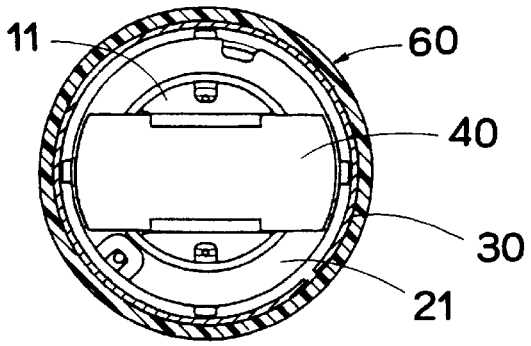
FIG. 2 is a sectional view of the ignition coil sectioned along a line II—II of FIG. 1.
Figure 12:
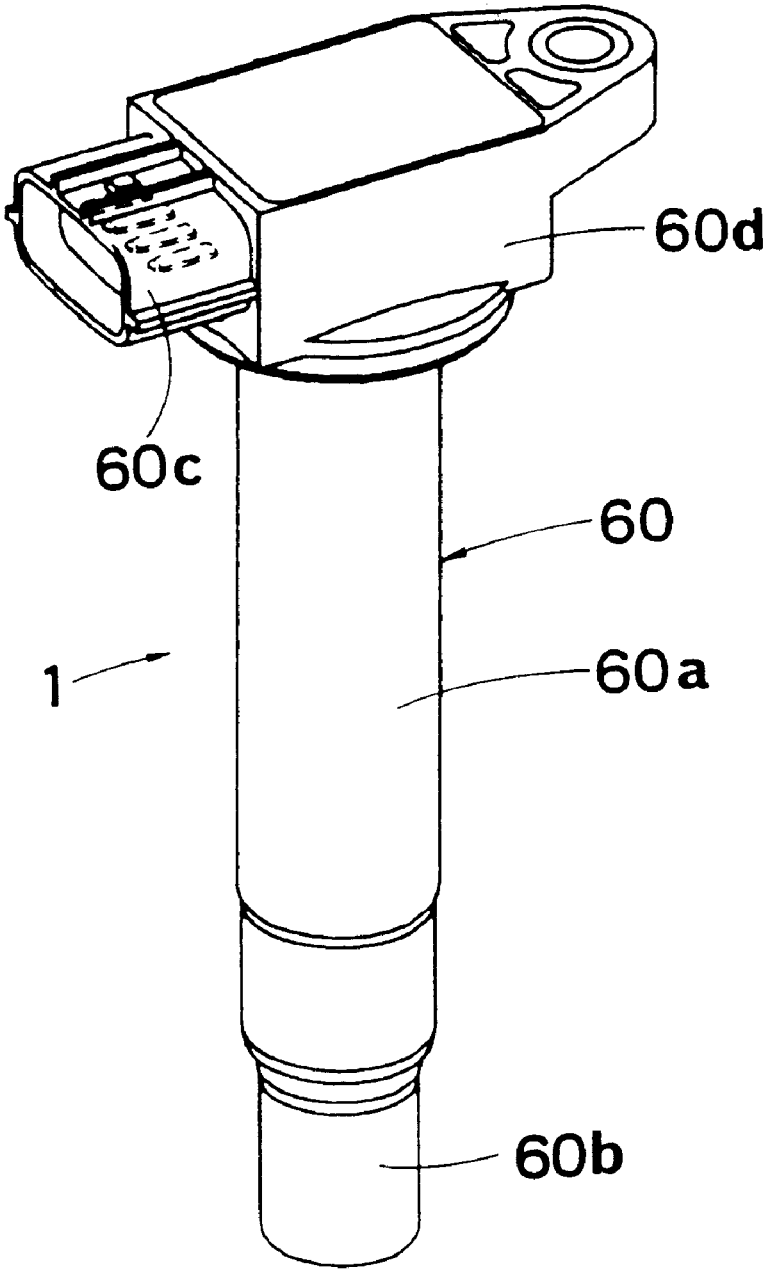
FIG. 12 is a perspective view of the ignition coil according to the embodiment of the present invention.
Figure 13:
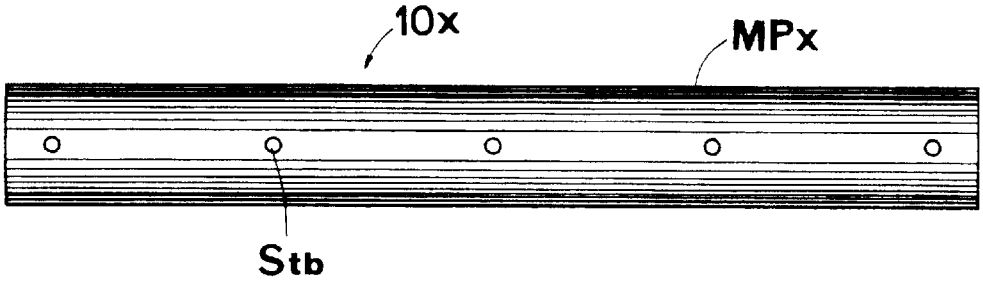
FIG. 13 is a plan view of an inner core having a plurality of silicon steel plates stacked one on the other to form a columnar member with a substantially circular cross section according to a provisional inner core.
Figure 14:
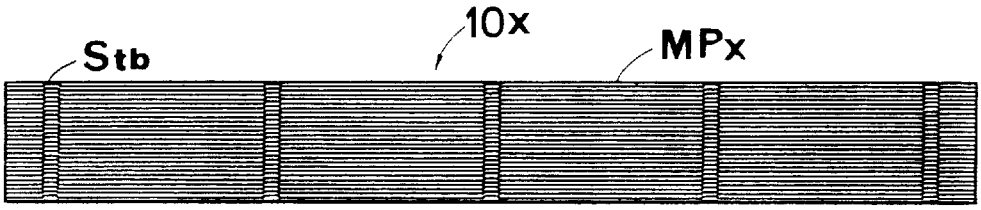
FIG. 14 is a longitudinally sectioned view of the inner core having the silicon steel plates stacked one on the other to form the columnar member with the circular cross section according to the provisional inner core.
Figure 15:
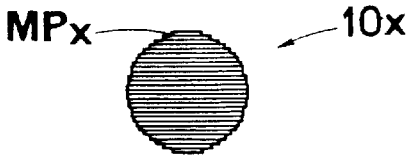
FIG. 15 is a side view of the inner core having the silicon steel plates stacked one on the other to form the columnar member with the circular cross section according to the provisional inner core.
Figure 16:
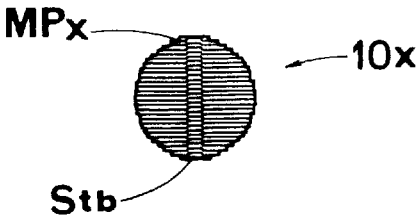
FIG. 16 is a horizontally sectioned view of the inner core having the silicon steel plates stacked one on the other to form the columnar member with the circular cross section according to the provisional inner core.

Referring to FIG. 12, there is illustrated an ignition coil for an internal combustion engine according to an embodiment of the present invention. A housing 60 of the present embodiment is a case made of synthetic resin, and includes a box-like igniter portion 60*d* which opens upward, a cylindrical coil portion 60*a* which extends from a bottom of the igniter portion 60*d*, and a plug cap portion 60*b*. The coil portion 60*a* is illustrated in FIGS. 1 and 2, in which the remaining portion of the ignition coil is omitted. FIG. 2 illustrates a sectional view sectioned along a line II—II in FIG. 1.

As shown in FIG. 1, the coil portion 60*a* includes therein an inner core 10 which corresponds to a columnar member according to the present invention, a primary bobbin 11 and a primary winding 12 which are formed to be integral with the inner core 10, a secondary coil assembly 20, an outer core 30 which corresponds to a cylindrical member according to the present invention, a pair of auxiliary cores 40, 40, and a pair of permanent magnets 50, 50. The igniter portion 60*d* as shown in FIG. 12 includes therein an igniter (not shown) and has a connector portion 60*c* which is formed to be integral with the igniter portion 60*d*. The igniter is provided for controlling a primary current of the primary winding 12, and may be called as an ignition module.

Figure 5:
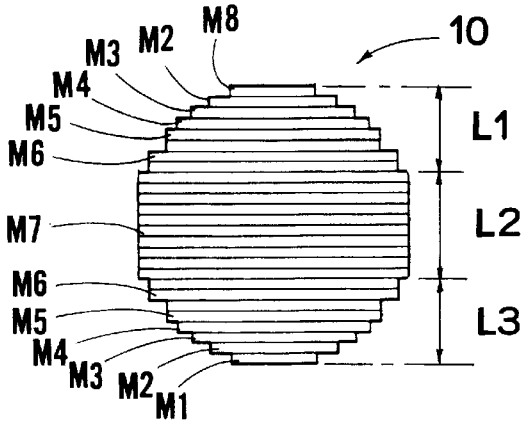
FIG. 5 is a horizontally sectioned view of the inner core according to the embodiment of the present invention.
Figure 10:
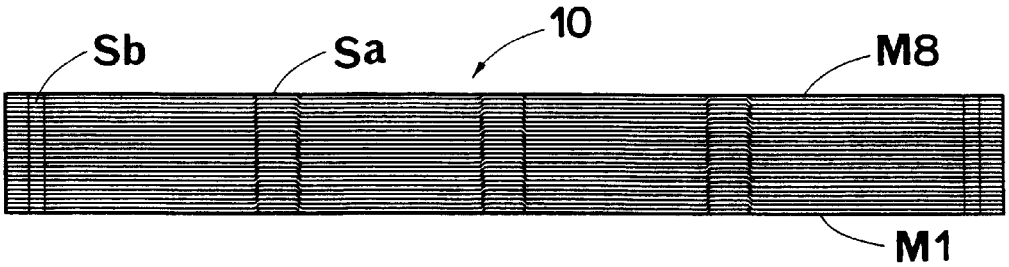
FIG. 10 is a longitudinally sectioned view of the inner core according to the embodiment of the present invention.
Figure 11:
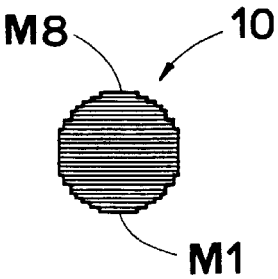
FIG. 11 is a horizontally sectioned view of the inner core according to the embodiment of the present invention.

FIGS. 8–11 illustrate the inner core 10 which has a plurality of magnetic plates, e.g., silicon steel plates M1–M8 which are stacked one on the other as shown in FIGS. 5 and 11 to form a stacked body with a substantially circular cross section. The inner core includes a first portion L1 having a plurality of silicon steel plates stacked one on the other in accordance with increase of a width of each plate, a second portion L2 connected to the first portion L1 and having a plurality of silicon steel plates with the same width stacked one on the other, and a third portion L3 connected to the second portion L2 and having a plurality of silicon steel plates stacked one on the other in accordance with decrease of a width of each plate, thereby to form a columnar member with its middle portion having a substantially circular cross section of about 8 mm in diameter. Whereas, each of its opposite end portions has a rectangular cross section which is greater in area than that of its middle portion. According to the stacking process of the present embodiment, through holes Ha, Hb are formed on the silicon steel plate M1, while a plurality of recesses are formed on one side of each of the silicon steel plates MP2 to MP8, and a plurality of protrusions are formed on the other side of them, when the silicon steel plates MP1 to MP8 are stamped. Then, the silicon steel plates MP2 to MP8 are stacked one on the other with each protrusion press-fitted into each recess mating with the protrusion thereby to form a plurality of stacked portions Sa, Sb, as will be described later in detail.

As shown in FIG. 5, eight kinds of silicon steel plates M1 to M8 (26 plates in total and each having a thickness of e.g., 0.3 mm) are stacked one on the other to form the inner core 10 having a first portion Li, a second portion L2, and a third portion L3. The silicon steel plate M1 to be placed at the outer most side (the lowest one in FIG. 5) is formed with through holes Ha, Hb as shown in the top row in FIG. 3, while the remaining silicon steel plates M2 to M8 are formed with stacking portions Sa, Sb. Each of the silicon steel plates Ml and M8 has a middle portion Ma narrower than the opposite end portions Mb, respectively, and the silicon steel plate M7 has the middle portion Ma of the maximum width (narrower than the opposite end portions Mb). The silicon steel plates M2 to M6 to be placed between the silicon steel plates M1 and M7, or between the silicon steel plates M8 and M7, includes one plate, two identical plates and ten identical plates, which are stacked one on the other to form the middle potions with their width gradually reduced from the plate placed at the center toward the plate placed at the outermost side.

Figure 3:
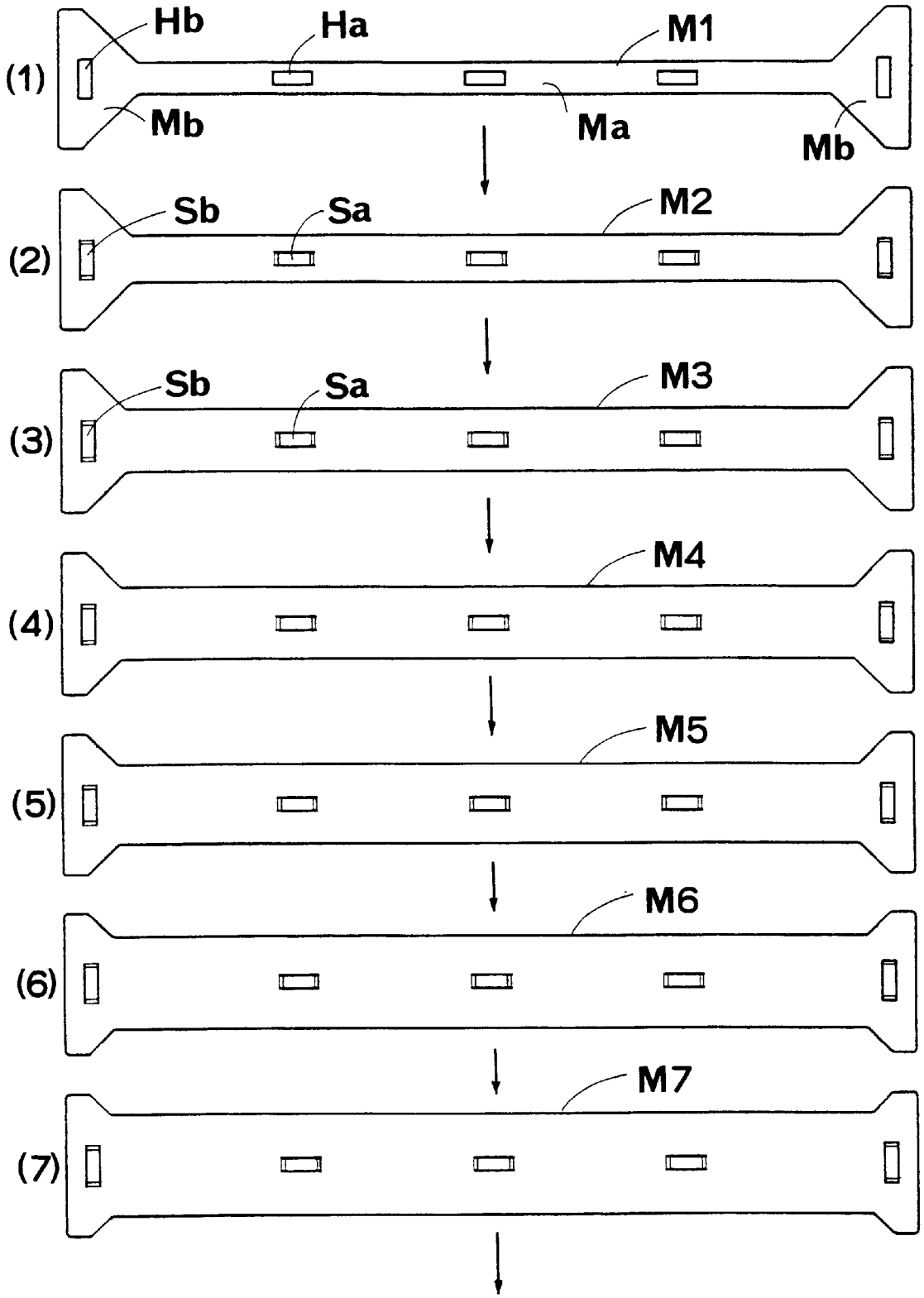
FIG. 3 is a plan view of a plurality of steel plates forming an inner core arranged in accordance with an assembling order according to the embodiment of the present invention.

In each of the silicon steel plates M2 to M8, the middle portion Ma is formed with three stacking portions Sa each having a rectangular plan view, and the opposite end portions Mb are formed with a stacking portion Sb having a rectangular plan view with its longer side perpendicular to the longer side of the rectangular stacking portion Sa, respectively. In the silicon steel plate M1 as shown in FIG. 3, the middle portion Ma is formed with three through holes Ha each having a rectangular plan view, and the opposite end portions Mb are formed with a through hole Hb having a rectangular plan view with its longer side perpendicular to the longer side of the through hole Ha, respectively. Each through hole Ha is formed in the same shape with that of the through hole Hb. The stacking portions Sa, Sb are fitted into the through holes Ha, Hb to be connected therewith through frictional engagement between the side surfaces of the stacking portions Sa, Sb and the through holes Ha, Hb, respectively.

Figure 4:
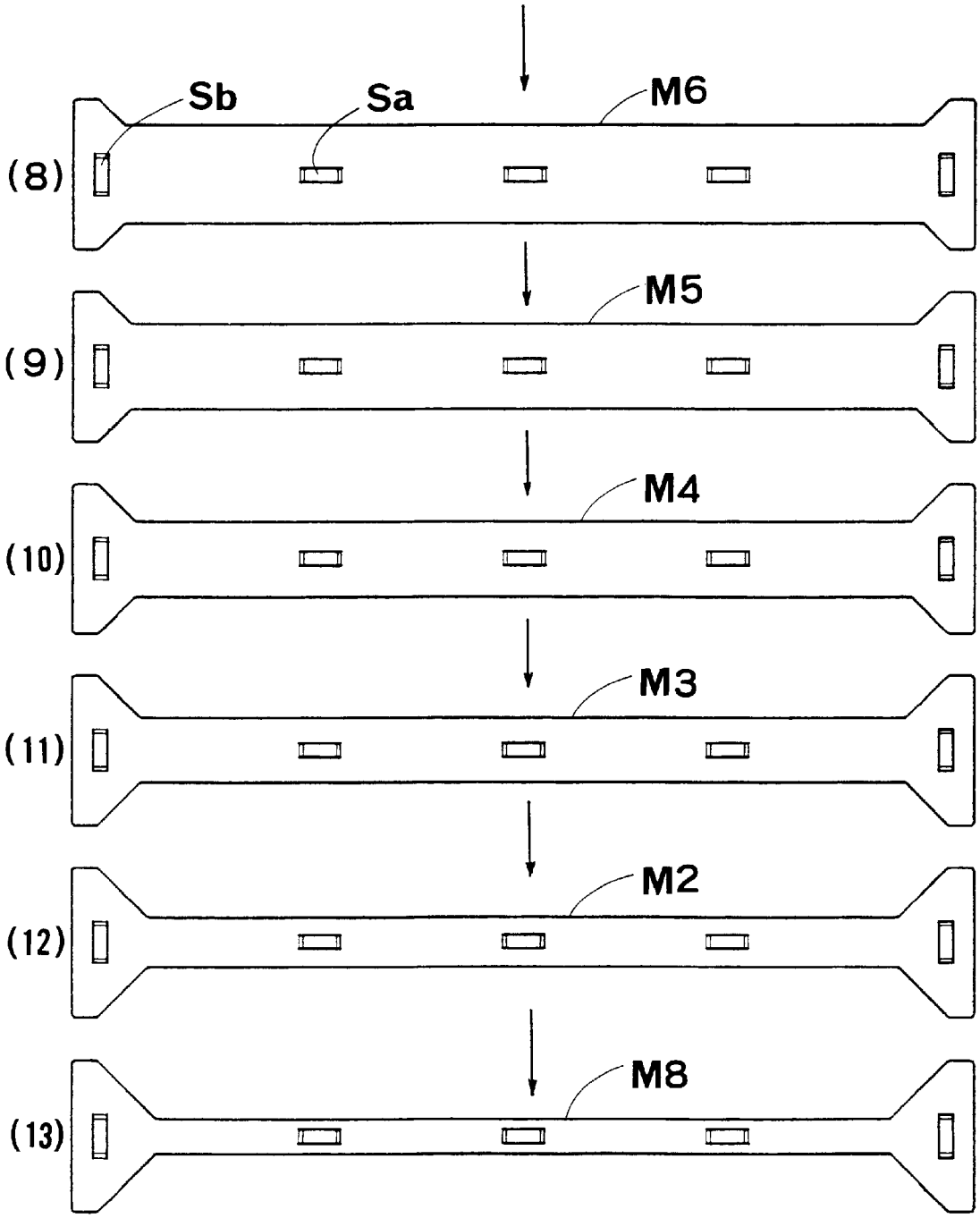
FIG. 4 is a plan view of a plurality of steel plates forming an inner core arranged in accordance with an assembling order according to the embodiment of the present invention.

Referring to FIG. 3, the silicon steel plate M2 is stacked on the silicon steel plate M1, so that the stacking portions Sa, Sb of the silicon steel plate M2 are fitted into the through holes Ha, Hb of the silicon steel plate M1. Then, on the silicon steel plate M2, are connected the silicon steel plates M3 and M4 which are similar in shape to the silicon steel plate M2, and each of which has the middle portion Ma formed greater in width than that of the silicon steel plate M2, respectively. On the silicon steel plate M4, a pair of the silicon steel plates M5 with the middle portions Ma greater in width than that of the silicon steel plate M4 are connected, and on the silicon steel plates M5, a pair of the silicon steel plates M6 with the middle portions Ma greater in width than that of the silicon steel plate M5 are connected. On the silicon steel plates M6, ten silicon steel plates M7 each having the middle portion Ma the greatest in width are connected by the stacking process. Then, the silicon steel plates M6, M5, M4, M3 and M2 are stacked in order on the silicon steel plates M7 according to the arrows as shown in FIG. 4 and connected together by the stacking process. Lastly, the silicon steel plate M8 having the smallest width (the same as that of the plate M1, i.e., narrowest plate) is stacked on the silicon steel plate M2 and connected together by the stacking process. As a result, the inner core 10 including the 26 silicon steel plates in total and having the approximately circular cross section is formed. In FIGS. 3 and 4, the arrows indicate the order for stacking the silicon steel plates.

Figure 6:
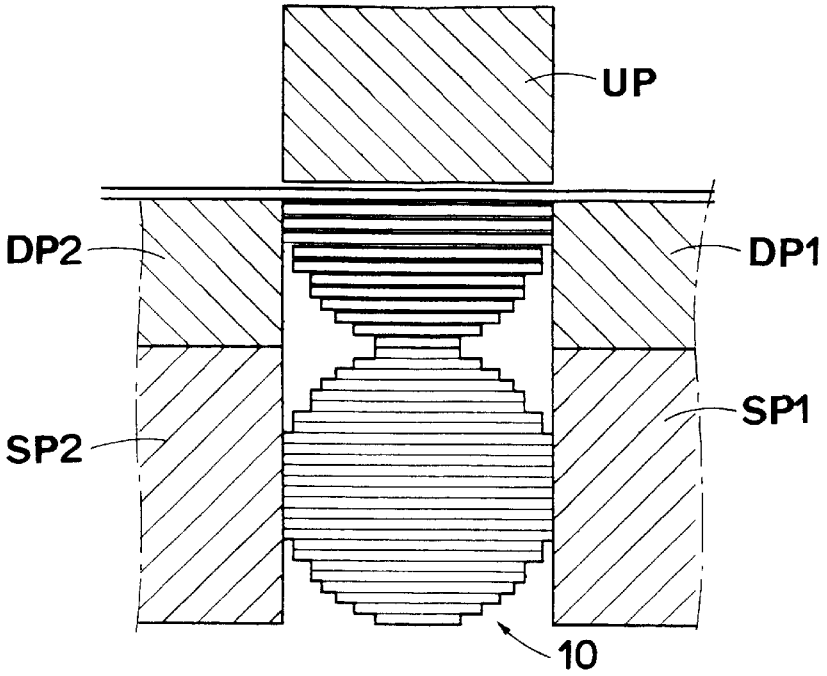
FIG. 6 is a sectional view of the inner core showing the process of the inner core according to the embodiment of the present invention.
Figure 7:
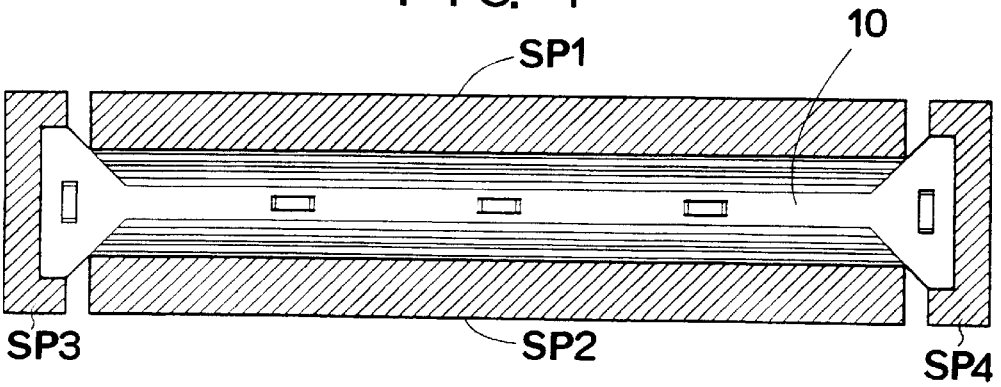
FIG. 7 is a sectional view of the inner core showing the process of the inner core according to the embodiment of the present invention.

FIGS. 6 and 7 shows a part of a manufacturing process of the inner core 10 according to the present embodiment, using a progressive die which incorporates a plurality of processing steps (e.g., 9 steps) into a single die and proceeds a belt-like material (silicon steel plate) in accordance with the steps one by one. Therefore, the belt-like material will not be separated until the product is punched out at the last step. In practice, seven kinds of punches for punching out seven configurations of the silicon steel plates M1 to M7 (M8 has the same configuration as M1), holing punches for forming holes in the plates, stacking punches for holing and stacking simultaneously, and punches for punching out the products are aligned to provide an upper die UP as shown in FIG. 6, which is a sectional view of the upper die UP, so that the punches are not shown. DP1, DP2 as shown in the lower part of FIG. 6 are die plates, and SP1, SP2 are squeeze plates. According to the present embodiment, the silicon steel plates M1 to M8 are stacked as described in the above, and the second portion L2 are formed with ten silicon steel plates M7 having the same width, so that the plates are firmly held between the squeeze plates SP1, SP2. When stacking, the silicon steel plates M1 to M8 are pressed, with these plates held between the squeeze plates SP1, SP2, as shown in FIG. 7. Accordingly, the silicon steel plates M1 to M8 are stacked in accordance with the order as shown in FIGS. 3 and 4 through the stacking process, so that the plates are firmly connected together even if the process is performed rapidly to provide a proper productivity.

Figure 8:
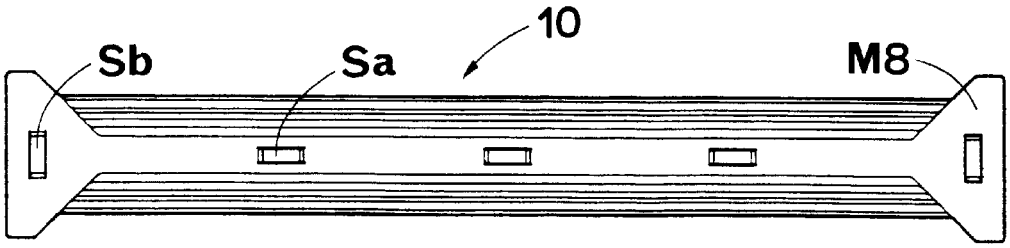
FIG. 8 is a plan view of the inner core according to the embodiment of the present invention.
Figure 9:
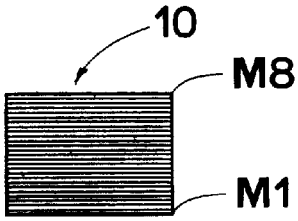
FIG. 9 is a side view of the inner core according to the embodiment of the present invention.

According to the present embodiment, the silicon steel plates mating with each other are connected by five stacked portions Sa, Sb in total as shown in FIGS. 8 and 10. The stacked portions Sa, Sb are formed in a rectangle, respectively, as shown in FIGS. 3 and 4. The protrusions of the stacked portions Sa, Sb are press-fitted into the recesses of the stacked portions Sa, Sb, or through holes Ha, Hb to be connected therewith through frictional engagement. The side surface of each protrusion of the stacked portions Sa, Sb is formed in a rectangle, while they may formed in any shapes, such as triangle (V shape), half circle and other shapes. Thus, according to the present embodiment, each protrusion of the stacked portions Sa, Sb has a large side area, so that its area to be contacted with each recess of the stacked portions Sa, Sb, or contacted with each of the through holes Ha, Hb is large. In addition, the longer side of the stacked portion Sa is arranged to be perpendicular to that of the stacked portion Sb. As a result, the connecting strength at each of the stacked portions Sa, Sb can be held to be greater than 2 kgf. In the drawings, hatching on the sectioned surface of the inner core 10 is omitted for better understanding of the structure.

As shown in FIG. 1, around the outer side of the inner core 10, synthetic resin is molded to form the primary bobbin 11 on which a wire of the primary winding 12 is wound to form two layers or four layers. The secondary coil assembly 20 includes a secondary bobbin 21 and a secondary winding 22 disposed thereon. The secondary bobbin 21 is made of synthetic resin and formed into a cylinder having a circular cross section. A plurality of collars (represented by 21*a*) are formed on the secondary bobbin 21 with a certain space between adjacent two of the collars 21*a* along the axis of the secondary bobbin 21. The wire of the secondary winding 22 is wound in each space between the collars 21*a*.

As shown in FIGS. 1 and 2, the outer core 30 is formed by a silicon steel plate in a cylindrical shape, to provide a magnetic circuit together with the inner core 10. The outer core 30 is fitted into the coil portion 60*a*. The permanent magnets 50, 50 are fixed to the opposite ends of the inner core 10, and further the auxiliary cores 40, 40 are fixed to the permanent magnets 50, 50. Each of the auxiliary cores 40, 40 is formed by stacking a plurality of substantially rectangular silicon steel plates, as shown in FIGS. 1 and 2. The permanent magnets 50, 50 are disposed such that the magnetic flux is generated from each of the permanent magnets 50, 50 normally in the same direction, but in the opposite direction to the magnetic flux which is generated in the inner core 10 when the primary winding 12 is energized. Thus, the magnetic circuit is provided by the inner core 10, permanent magnets 50, 50, auxiliary cores 40, 40, and the outer core 30.

When manufacturing and assembling the above ignition coil, a plurality of, e.g., 26 pieces with 8 kinds of silicon steel plates M1 to M8 (having a thickness of e.g., 0.3 mm each) are connected by the stacking process to form the inner core 10. The primary bobbin 11 is formed outside of the inner core 10 to be integral therewith as shown in FIG. 1, and the primary winding 12 is wound around the primary bobbin 11. The outer core 30 is the cylindrical member formed by the silicon steel plate as described before, and inserted or pressed into the inside of the coil portion 60*a* of the housing 60. The secondary winding 22 is wound around the secondary bobbin 21 to form the secondary coil assembly 20. Then, the primary bobbin 11 having the primary winding 12 wound thereon and the inner core 10 are received in the hollow portion of the secondary bobbin 21, so that the opposite end portions of the primary bobbin 11 are fitted into the hollow portion of the secondary bobbin 21.

The inner core 10, secondary coil assembly 20 and etc. are received into the outer core 30, after the permanent magnets 50, 50 and auxiliary cores 40, 40 are fixed to the opposite ends of the inner core 10. Then, the igniter (not shown) is received into the igniter portion 60*d* of the housing 60, and the opposite ends of the wire of the primary winding 12 is electrically connected to the igniter. One end of the wire of the secondary winding 22 is grounded, and the other end is connected to a high-tension terminal (not shown).

Thereafter, a thermosetting synthetic resin such as epoxy resin is filled into the coil portion 60*a* and igniter portion 60*d*, and set to form a resin portion 13 within the coil portion 60*a* as indicated by dots in FIG. 1 (the resin portion 13 within the igniter portion 60*d* is omitted in FIG. 1). Thus, the primary and secondary windings 12 and 22 are impregnated and made rigid with such resin, and the insulation is ensured to endure the high-tension output from the secondary winding 22. The coil portion 60*a* and plug cap portion 60*b* as shown in FIG. 12 may be formed separate from the igniter portion 60*d* and connector portion 60*c*, and then the coil portion 60*a* may be connected to the igniter portion 60*d*.

The ignition coil 1 is, therefore, formed into the configuration as shown in FIG. 12, and a plug socket (not shown) which is made of insulating material (e.g., rubber) in the form of a cylinder, may be fitted onto the outside of the coil portion 60*a* and plug cap portion 60*b*. Then, the ignition coil 1 is installed in the internal combustion engine (not shown), and connected to an ignition plug (not shown). In operation, when a primary current is fed to the primary winding 12 and cut off, alternately, a counter electromotive force is induced in the secondary winding 22, so that such a high-tension as 30–40 kV is fed to each ignition plug. As a result, a spark discharge is caused at an electrode of the ignition plug to ignite a compressed air-fuel mixture in a combustion chamber (not shown).

As described above, the inner core 10 of the ignition coil 1 includes a plurality of silicon steel plates M1 to M8 which are stacked one on the other and connected with sufficient strength at the stacked portions Sa, Sb. As a result, the entire area of the cross section of the middle portion 10*b* can be used for the magnetic circuit, and an effective magnetic flux density can be increased by the end portions 10*a* having the large cross section. With respect to an area-share rate which is a rate shared by an area of a core in an area enclosed by an outer member, it is difficult to increase the area-share rate of the prior inner core assembled by a plurality of wires, because gaps between the wires are summed up. According to the present embodiment, however, the gaps in the inner core 10 are so small that the area-share rate will be increased largely. Therefore, the area of the cross section of the inner core 10 can be made smaller, maintaining a predetermined ignition property, so that the ignition coil 1 as a whole can be made smaller than the conventional ignition coil.

It should be apparent to one skilled in the art that the above-described embodiment is merely illustrative of but one of the many possible specific embodiments of the present invention. Numerous and various other arrangements can be readily devised by those skilled in the art without departing from the spirit and scope of the invention as defined in the following claims.

What is claimed is:

1. An ignition coil for an internal combustion engine comprising:

a magnetic columnar member having a plurality of magnetic plates stacked one on the other, said magnetic columnar member including a first portion having a plurality of magnetic plates stacked one on the other in accordance with increase of a width of a middle portion of each plate, a second portion connected to said first portion and having a plurality of magnetic plates with middle portions thereof having the same width stacked one on the other, and a third portion connected to said second portion and having a plurality of magnetic plates stacked one on the other in accordance with decrease of a width of a middle portion of each plate, thereby to form said columnar member with a middle portion thereof having a substantially circular cross section, and the opposite end portions of said columnar member having a substantially rectangular cross section, respectively, wherein a plurality of rectangular recesses formed on one side of each of said magnetic plates and a plurality of rectangular protrusions formed on the other side of each of said magnetic plates are connected to form a plurality of rectangular stacked portions on said columnar member, and wherein a longer side of each rectangular stacked portion formed on the opposite end portions of said columnar member is arranged perpendicularly to a longitudinal axis of said columnar member, and a longer side of each rectangular stacked portion formed on the middle portion of said columnar member is arranged along the longitudinal axis of said columnar member; and a primary winding and a secondary winding wound around said columnar member.

2. An ignition coil for an internal combustion engine as set forth in claim 1, wherein a plurality of through holes are formed on the narrowest plate in said first portion to be connected to said protrusions of said magnetic plates mating with said narrowest plate.

3. An ignition coil for an internal combustion engine as set forth in claim 1, wherein said magnetic plates are made of silicon steel plates.

4. An ignition coil for an internal combustion engine as set forth in claim 1, wherein the substantially rectangular cross sections of the opposite end portions of said columnar member are greater in area than the substantially circular cross section of the middle portion of said columnar member, respectively.

5. An ignition coil for an internal combustion engine comprising:

a magnetic columnar member having a plurality of magnetic plates stacked one on the other, said magnetic columnar member including a first portion having a plurality of magnetic plates stacked one on the other in accordance with increase of a width of a middle portion of each plate, a second portion connected to said first portion and having a plurality of magnetic plates with middle portions thereof having the same width stacked one on the other, and a third portion connected to said second portion and having a plurality of magnetic plates stacked one on the other in accordance with decrease of a width of a middle portion of each plate, thereby to form said columnar member with a middle portion thereof having a substantially circular cross section, and end portions of each of the stacked plates having substantially the same width, thereby forming opposite end portions of said columnar member having substantially rectangular cross sections when assembled.

6. An ignition coil for an internal combustion engine as set forth in claim 5, wherein a plurality of rectangular recesses are formed on one side of each of said magnetic plates, and a plurality of rectangular protrusions are formed on the other side of each of said magnetic plates, wherein said recesses and said protrusions are connected to form a plurality of rectangular stacked portions on said columnar member, and wherein a longer side of at least one of said rectangular stacked portions is perpendicular to a longer side of another one of said rectangular stacked portions.

7. An ignition coil for an internal combustion engine as set forth in claim 6, wherein the longer side of each rectangular stacked portion formed at the opposite ends of said columnar member is perpendicular to the longer side of each rectangular stacked portion formed between the opposite ends of said columnar member.

8. An ignition coil for an internal combustion engine as set forth in claim 5, wherein a plurality of through holes are formed on the narrowest plate in said first portion to be connected to protrusions of said magnetic plates mating with said narrowest plate.

9. An ignition coil for an internal combustion engine as set forth in claim 5, wherein said magnetic plates are made of silicon steel plates.

10. An ignition coil for an internal combustion engine as set forth in claim 5, wherein the substantially rectangular cross sections of the opposite end portions of said columnar member are greater in area than the substantially circular cross section of the middle portion of said columnar member.

11. An ignition coil for an internal combustion engine as set forth in claim 5, further comprising a primary winding and a secondary winding wound around said columnar member.

12. An ignition coil for an internal combustion engine as set forth in claim 11, further comprising a magnetic cylindrical member for receiving therein said columnar member with said primary winding and said secondary winding wound around said columnar member.

* * * * *